United States Patent [19]

Rhea

[11] 4,291,427

[45] Sep. 29, 1981

[54] FLOATATION GARMENT

[76] Inventor: Richard L. Rhea, P.O. Box 27468, St. Louis, Mo. 63141

[21] Appl. No.: 949,758

[22] Filed: Oct. 10, 1978

[51] Int. Cl.[3] ..... B63C 9/08

[52] U.S. Cl. ..... 9/335

[58] Field of Search ..... 9/329, 334, 335, 336, 9/337, 338, 340, 341, 342, 343; 29/18, 20, 24, 161 A, 267, 255

[56] References Cited

U.S. PATENT DOCUMENTS

| | | | |
|---|---|---|---|
| 2,490,556 | 12/1949 | Spack | 9/335 |
| 3,144,668 | 8/1964 | Palesotti | 9/329 |
| 3,257,666 | 6/1966 | Hoffman | 2/267 |
| 3,646,626 | 3/1972 | Frieder | 9/342 |

FOREIGN PATENT DOCUMENTS

| | | | |
|---|---|---|---|
| 103118 | 11/1965 | Denmark | 9/341 |

*Primary Examiner*—Galen L. Barefoot

*Attorney, Agent, or Firm*—Polster, Polster and Lucchesi

[57] ABSTRACT

A floatation garment adapted to aid in keeping the user afloat in the water. The garment has at least one floatation pad of suitable flexible floatation material of a predetermined thickness, the pad having one or more lines of reduced thickness extending across the pad. A fabric cover or shell having an outer and inner panel is provided with the floatation pad being disposed within a pocket between the outer and inner panels. The outer and inner panels are sewn to the pad and to one another along the lines of reduced thickness thereby to hold the pad in place with respect to the shell and to permit the garment to readily be flexed along the lines of reduced thickness.

6 Claims, 4 Drawing Figures

FLOATATION GARMENT

BACKGROUND OF THE INVENTION

This invention relates to a floatation garment and more particularly to a bathing suit having floatation material incorporated therein so as to aid boaters, water skiers, and swimmers in staying afloat when in the water.

Floatation devices or life preservers are generally divided into two main classes: those intended to be worn by the user (e.g., a vest-type life preserver) and those intended to be grasped by the user (e.g., a buoyant cushion or a ring buoy). Generally, most life vests and other floatation devices worn on the body are bulky, hot, and cumbersome to wear and thus are not worn for extended periods of time by fishermen, boaters, and water skiers. Thus, in many instances, for example, when a person is unexpectedly thrown from a boat, he may not be wearing a life preserver.

Heretofore, buoyant garments were known in which a suitable floatation material was incorporated within the garment. However, these floatation garments were bulky, stiff, and uncomfortable. The stiffness of these prior floatation garments inhibited free movement of bathers, water skiers, and boaters. This in turn resulted in their not being worn during normal water sport activities.

Reference may be made to such prior patents as U.S. Pat. Nos. 2,775,776 and 3,935,608 which disclose various buoyant garments in the same general field as this invention.

SUMMARY OF THE INVENTION

Among the several objects and features of this invention may be noted the provision of a floatation garment and more particularly a buoyant bathing suit or the like intended to be worn on the body for aiding the wearer in staying afloat when in the water;

The provision of such a floatation garment which is comfortable for long periods of time, which does not substantially interfere with movement of the wearer, and which is conducive to being worn for long periods during normal water sport activities;

The provision of such a floatation garment which is comfortable in which to sit and which provides a cushion seat for the wearer;

The provision of such a floatation garment which, in some measure, protects a water skier against injury in the event of a fall while waterskiing;

The provision of such a floatation garment which remains buoyant indefinitely; and The provision of such a floatation garment which is relatively easy and inexpensive to manufacture and which has a long service life.

Briefly, a floatation garment of this invention is intended to be worn on the user's body and to aid in keeping the user afloat. The garment comprises at least one floatation pad of suitable floatation material of a predetermined thickness, the pad being flexibly bendable and having one or more lines of reduced thickness extending across the garment. A fabric cover or shell is provided having an outer and an inner panel with the pad disposed between the inner and outer panels. The inner and outer panels are sewn to the pad and to one another along the lines of reduced thickness on the pad thereby to hold the pad in place with respect to the cover and to permit the garment to be readily flexed along the lines of reduced thickness.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
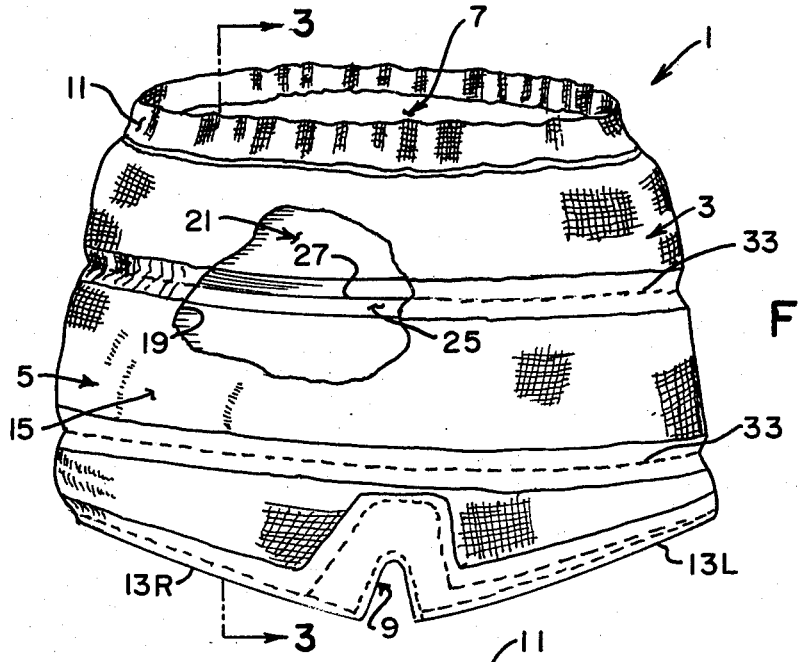
FIG. 1 is a front perspective view of a floatation bathing suit or garment of the present invention with a portion of the fabric shell or cover of the garment being broken away to illustrate a floatation pad disposed within the cover.

Referring now the drawings, a floatation garment (e.g., a swim suit) of this invention is indicated in its entirety by reference character 1. The garment herein described and shown in the drawings is in the form of a pair of swim trunks intended to be worn on the lower torso and on the upper legs of the wearer. The garment comprises a fabric shell or cover 3 having a front section 5, a back section 7, and a crotch section 9. The front and back sections are joined at the sides of the garment and the crotch section interconnects the bottom of the front and back sections. The garment has an elasticized waist band 11 defining a waist opening at the top of the garment. The lower edges of the front and back sections and the crotch section cooperate to form two leg openings, as indicated at 13R and 13L.

Figure 3:
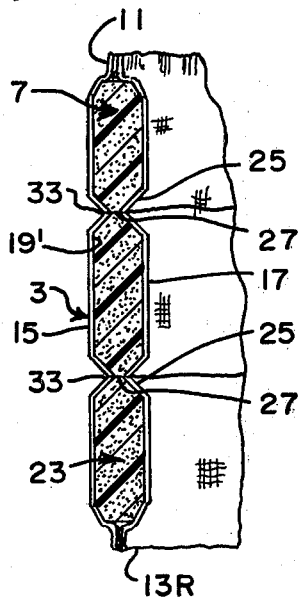
FIG. 3 is a vertical cross sectional view of the back section of the garment taken along line 3—3 of FIG. 1.

More specifically, shell 3 is shown to be made of suitable cloth or fabric, such as a suitable rip-stop nylon or the like. Front and back sections 5 and 7 of shell 3 each include an outer cloth panel 15 and an inner cloth panel 17 (see FIG. 3) forming a front pocket 19 and a rear pocket 19' therebetween. A front floatation pad 21 is enclosed within front pocket 19 formed in front section 5 and a back floatation pad 23 is enclosed within rear pocket 19' formed in the back section 7. These floatation pads are generally similar to one another and are preferably formed from a suitable floatation material, such as a closed cell, polyvinylchloride, expanded-foam material. Preferably these pads are formed from sheets of the foam material of a predetermined thickness, for example, having a thickness of approximately 1 inch (2.54 cm). As indicated at 25 (see FIG. 4), generally V-shaped grooves are provided in the pad and extend transversely across the pad (i.e., from side-to-side of garment 1) so as to constitute so-called lines of reduced thickness of the pad. It will be noted that the pad is preferably not severed along the lines of reduced thickness, but rather the individual sections of the pad defined by lines of reduced thickness 25 are joined together by so-called webs 27 at the apex or bottom of the lines of reduced thickness. Thus, lines of reduced thickness 25 constitute lines along which the floatation pads are permitted to flex relatively freely in accordance with this invention. Although the grooves 25 preferably extend transversely across the pad, other extension directions are compatible with the broader aspects of the invention.

Figure 4:
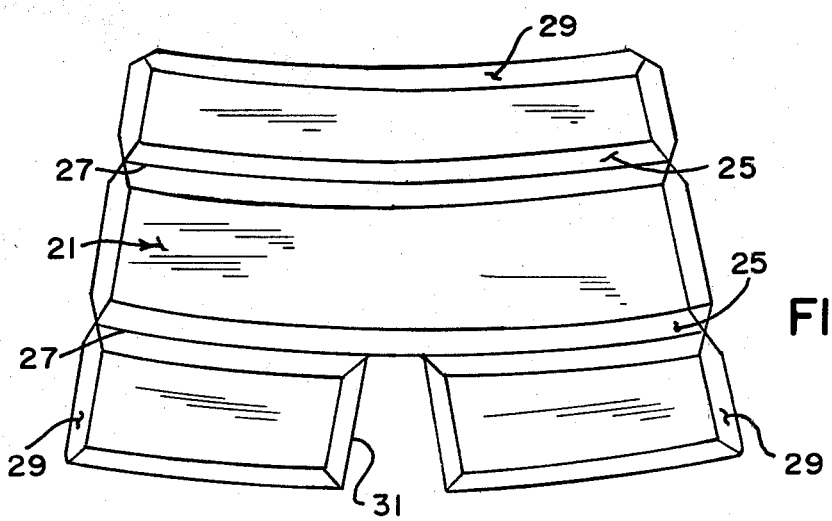
FIG. 4 is a front perspective view of a floatation pad used in the bathing suit of this invention, the pad being shown to have lines of reduced thickness extending generally laterally from side-to-side of the pad.

As best shown in FIG. 4, the outer edges 29 of floatation pads 21 and 23 are beveled so that they more smoothly fit in shell 3. Also, each pad has a notch 31 in its bottom edge. These notches in front and back pads allow crotch section 9 to extend up into the pads, and permit the crotch section to remain flexible.

Further in accordance with this invention, lines of stitching 33 are provided on the front and back sections 5 and 7 in the area of lines of reduced thickness 25 so as to stitch together inner panel 15 and outer panel 17 of the front and back garment sections. More specifically, it will be noted that stitching 33 not only extends not through the inner and outer panels, but the stitching also extends through the web portions of the front and rear floatation pads so as to securely hold the floatation pad in place within shell 3. In this manner, the entire garment may be relatively freely flexed along lines of reduced thickness 25 thereby to permit ease of movement of garment 1. Also, the lines of stitching 33 through the floatation pads securely hold the latter in place within the shell 3 and thus prevent shifting of the floatation pad relative to the swimming suit or relative to the wearer's body.

Figure 2:
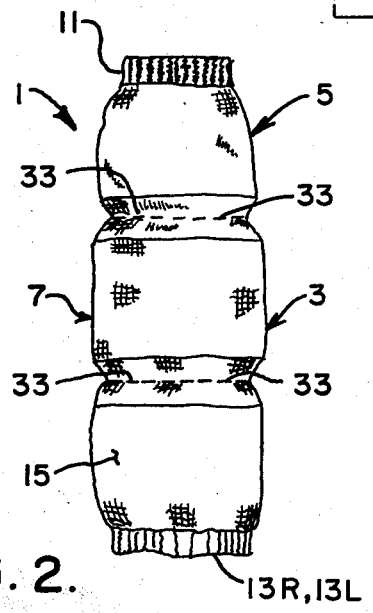
FIG. 2 is a left side elevational view of the garment shown in FIG. 1.

As best shown in FIG. 2, the ends of the front and back floatation pads 21 and 23 meet (or nearly meet) at the sides of garment 1 and thus provide a floatation band of relatively uniform thickness around a wearer's hips.

Upon the user of garment 1 of this invention donning the floatation garment, it will be noted that the wearer at all times carries with him a floatation device. In the event the wearer of garment 1 unexpectedly finds himself in the water, the garment will aid in keeping him afloat. Also, the padding of the floatation device (specifically, back floatation pad 23) may serve as a seat cushion for the user. If the garment of this invention is worn by a water skier, for example, the padding provided by the floatation pads may serve to prevent or reduce injury to the skier in the event of a fall.

Because of notches 31 in the bottom portions of each of the floatation pads 21 and 23, and because crotch section 9 does not have any of the main floatation pads included therewithin, the crotch section is supple permitting comfortable wearing of garment 1 of this invention. It will be understood, however, that certain designs of garments of this invention may include padding in the crotch section which is preferably considerably thinner than pads 21 or 23 so as to permit flexing of the garment.

Garment 1 was hereinabove described as having stitching joining the outer and inner panels 15 and 17 of shell 3 to floatation pad 21 along lines of reduced thickness 25. However, it will be understood that in accordance with the broader aspects of this invention that the shell need not be sewn to the floatation pad and that the lines of reduced thickness will still function to permit the ready bending or flexing of garment 1.

In view of the above, it will be seen that the several objects and features of this invention are achieved and advantageous results attained.

As various changes could be made in the above construction without departing from the scope of the invention, it is intended that all matter contained in the above description or shown in the accompanying drawings shall be interpreted as illustrative and not in a limiting sense.

I claim:

1. A floatation garment adapted to be worn on the body and to aid in keeping the wearer afloat, said garment comprising at least two floatation pads of suitable floatation material, each of said at least two pads have beveled outer edges, each of said at least two pads comprising a plurality of sections of generally uniform predetermined thickness with a preformed groove between the sections and with a web at the apex of said groove joining said sections, each of said at least two pads being flexible bendable along said groove, a fabric cover having an inner and an outer panel with said at least two pads being disposed between said inner and outer panels, said inner and outer panels being sewn to said at least two pads and to one another only along said groove with lines of stitching being only through said web thereby to hold said at least two pads in place within said cover and to permit said garment to be readily flexed along said groove without restriction from said stitching.

2. A buoyant swimming garment having a waist opening and two leg openings, said garment having a fabric shell including an outer panel and an inner panel forming at least a pair of pockets therebetween, said garment further having at least one pad of suitable, flexible floatation material disposed within each of said pockets between said inner and outer panels, said at least one pad in each pocket having beveled outer edges and a plurality of lines of reduced thickness extending therealong, said lines of reduced thickness being preformed in said at least one pad prior to sewing of the garment portions of the at least one pad on opposite sides of the lines of reduced thickness being joined together by a web portion, said inner and outer panels of each pocket being sewn to said at least one pad only along said lines of reduced thickness with lines of stitching through only said web portions thereby to secure said at least one pad in place within its respective said pocket and to permit said garment to be readily flexed along said lines of reduced thickness when worn.

3. Buoyant swimming trunks intended to be worn on the lower body of the wearer, said trunks comprising a fabric garment having a front section, a back section, and a crotch section interconnecting the bottoms of the front and back sections so as to define two leg openings, the upper ends of said sections defining a waist opening, said front and back sections each being comprised of an outer fabric panel and an inner fabric panel defining front and rear pockets, a front floatation pad enclosed within said front pocket, a back floatation pad enclosed within said rear pocket, each of said pads being of a suitable floatation material and being of generally uniform thickness, each of said pads having at least one line of reduced thickness extending therealong so as to permit the ready bending and flexing of said bathing trunks along said lines of reduced thickness, at least one of said outer and inner panels of said front and back sections being sewn to its respective floatation pad along said lines of reduced thickness.

4. Buoyant swimming trunks as set forth in claim 3 wherein each of said floatation pads has a bottom margin with a notch therein, said crotch section extending into said notches thereby enabling freedom of movement of said crotch section.

5. Buoyant swimming trunks as set forth in claim 3 wherein said lines of reduced thickness on each of said floatation pads extend in generally side-to-side direction of said pads across the front and back of the bathing trunks.

6. Buoyant swimming trunks as set forth in claim 3 wherein both of said floatation pads have at least one outer edge, and wherein at least one of outer edge of at least one of said floatation pads is beveled so that said pad fits more smoothly within its respective pocket.

* * * * *